US006062700A

United States Patent [19]

Price

[11] Patent Number: 6,062,700

[45] Date of Patent: May 16, 2000

[54] FLASHLIGHT ARMBAND

[76] Inventor: Ray Price, HCR 3 Box 1075, Tucson, Ariz. 85739

[21] Appl. No.: 09/233,678

[22] Filed: Jan. 19, 1999

Related U.S. Application Data

[60] Provisional application No. 60/098,796, Sep. 1, 1998.

[51] Int. Cl.[7] ..... F21V 21/00

[52] U.S. Cl. ..... 362/103; 362/190; 362/191; 362/205; 362/394

[58] Field of Search ..... 362/103, 190, 362/191, 205, 249, 394

[56] References Cited

U.S. PATENT DOCUMENTS

| | | | |
|---|---|---|---|
| 1,278,738 | 9/1918 | Petrice | 362/103 X |
| 1,307,456 | 6/1919 | Prahar | 362/103 X |
| 1,325,885 | 12/1919 | Weber | 362/103 X |
| 1,346,714 | 7/1920 | Kulmann | 362/103 X |
| 1,457,023 | 5/1923 | Fergusson | 362/103 X |
| 1,769,241 | 7/1930 | Stephani | 362/103 |
| 4,462,064 | 7/1984 | Schweitzer | 362/190 X |
| 5,053,932 | 10/1991 | Case | 362/190 X |
| 5,154,506 | 10/1992 | Leard | 362/103 |
| 5,183,193 | 2/1993 | Brandell | 362/103 X |
| 5,345,368 | 9/1994 | Huff | 362/103 |
| 5,448,458 | 9/1995 | Smyly, Jr. | 362/103 X |

*Primary Examiner*—Laura K. Tso
*Attorney, Agent, or Firm*—Mark E. Ogram, P.C.

[57] ABSTRACT

An armband which provides a platform for both holding and directing a beam of light from a flashlight as well as protection from blows and knife attacks. The armband has a circular body which is slipped over the forearm of the user The armband provides mild compression of the forearm so that the armband does not readily slip off of the user. The armband is further tightened using at least one fastening strap which "cinches" the armband tighter onto the arm. In the preferred embodiment, two fastening straps are used, one above and one below the muscle bulge on the forearm. The flashlight is secured to the armband to direct the beam of light parallel to the forearm. Activation of the flashlight is by tapping a spring activator which engages the switch on the flashlight. To provide further protection, a shield is also incorporated into the armband. In the preferred embodiment the shield is removable from the armband, but, in other embodiments, the shield is embedded into the armband itself.

23 Claims, 4 Drawing Sheets

FLASHLIGHT ARMBAND

BACKGROUND

This is a continuation-in-part of U.S. Provisional Application Ser. No. 60/098,796, filed on Sep. 1, 1998, and entitled "Flashlight Armband".

This invention relates generally to flashlights and more particularly to apparatus used to secure flashlights to a user.

Ever since the first miner attached a candle to his headgear, man has sought to attach lights to their body for one purpose or another. While miners and campers often use "head lamps" in their occupation and vocation, bicycle riders and joggers often attach a strobe light to their upper arm to increase their visibility to motor vehicles.

In many occupations, the use of a flashlight is extremely important. As example, a police officer is often required to use a flashlight when they inspect buildings, stop a vehicle at night, or pursue a criminal through a darkened building. In such situations, the police officer is put at a significant disadvantage since they must use one hand to hold the flashlight and, in many situations, attempt to use their firearm.

Even when a firearm is not used, should a fight or struggle ensue, the police officer is at an initial disadvantage since he is grasping the flashlight instead of having both hands free to thwart the attack of the other party.

It is clear that particularly in field of law enforcement, there is a need to properly secure a flashlight to the police officer.

SUMMARY OF THE INVENTION

The present invention creates an armband which provides a platform for both holding and directing a beam of light from a flashlight as well as protection for the user against blows and knife attacks. In this regard, the armband provides a useful dual purpose for the user, such as a police officer.

In applying the armband, its circular body is slipped over the forearm of the user and is positioned. The armband provides a mild compression of the forearm so that the armband does not readily slip off of the user. This compression is accomplished in a variety of ways. In the preferred embodiment, part o the circular body is formed of an elastic material which allows the circular body to expand when being placed over the forearm, and then contract around the forearm.

Once positioned, the armband is further tightened using at least one fastening strap which "cinches" the armband tighter onto the arm. This cinching action is intended to secure the armband to the forearm and should not be applied to a level which restricts blood flow to the hand.

In the preferred embodiment, two fastening straps are used, one medial and one distal of the muscles in the forearm. This configuration of fastening straps provides for proper fastening of the armband without causing discomfort to the user.

The flashlight is secured to the armband to direct the beam of light parallel to the forearm. While the preferred embodiment utilizes a loop of elastic to secure the flashlight, those of ordinary skill in the art readily recognize a variety of other techniques which can be used to grasp the handle of the flashlight. One example of such is the use of a hook-and-loop fastener on a wide band which is used to sandwich the flashlight handle against the circular member.

In the invention, activation of the flashlight is accomplished by tapping a spring activator which engages the switch on the flashlight. The spring member is secured at one end to the grasping mechanism for the flashlight with the other end positioned "over" the flashlight's switch. When this "free end" of the spring is pressed or tapped by the user, it engages the flashlight switch to either activate or de-activate the flashlight.

In this manner, the user is able to activate/de-activate the flashlight with a simple tap (such as with the back of their free hand, against a door jam, against the leg, etc.). The user no longer needs to "find" the switch to activate it.

Further, in the preferred embodiment of the invention, a shield is also incorporated into the armband. The armband in this fashion, not only secures the flashlight, but further, in a struggle or fight, protects the user's arm from blows and knife cuts.

In one embodiment, the shield is removable from the armband. In this embodiment, the shield is usually secured to the inside of the armband on a surface opposite that of the flashlight. In another embodiment, the shield is shaped to be placed on the external surface of the armband with an opening so that the shield encircles the holder of the flashlight.

In some embodiments, the shield is embedded into the armband itself. Often this is done in elongated strips (such as hardened plastic or metal) so that the armband remains relatively flexible.

As shown above, the present invention provides a protective band which is used to hold a flashlight on the forearm of a user.

A spring mechanism is used to selectively engage the switch of the flashlight. The spring mechanism is configured such that by a "snap of pressure", the switch on the flashlight is engage/disengaged. This "snap of pressure" does not require the use of a hand; rather, a quick striking of the spring mechanism against another part of the user's body, against a door frame, against an automobile hood, or any other such activity, activates the flashlight.

In this manner, the police officer can easily activate/deactivate the flashlight without requiring the use of the officer's hand. Further, since the flashlight is secured to the officer's forearm, the officer's hands are free and not encumbered.

The band of this invention is structured to fully encircle the officer's forearm and is manufactured in a variety of sizes to fit the particular officer's forearm. The encircling member is ideally constructed of two different types of materials: an inelastic portion and an elastic portion.

The inelastic portion of the band is used to secure the flashlight and provide the foundation for the sleeve holding the flashlight and the spring mechanism. In one embodiment of the invention, a rigid backing is provided within the inelastic portion to provide further protection for the officer in much the same manner as a shin-guard does in baseball.

The elastic portion of the band provides the required tension to keep the band from slipping from the forearm of the officer.

In one embodiment of the invention, the band is also equipped with two tightening straps which extend over the elastic portion to provide even more security from the band being dislodged. The use of both the elastic and the tightening straps also provides the added confidence that when the officer is involved in a struggle, if the tightening straps are broken or dislodged, the band does not fall from the officer or slip away.

In the preferred embodiment, the tightening straps are attached at one end to the band and are meant to wrap around the arm band and reattach to the band using hook-and-loop fasteners such as VELCRO.

While the discussion above addresses the use of the invention in a law enforcement setting, the invention is not so limited and is also useful for such variety of activities as: camping and hiking, repairing a vehicle at night, repairs made in a darkened building, and bicycle riding or repair.

The invention, together with various embodiments thereof will be more fully explained by the accompanying drawings and the following description.

DRAWINGS IN BRIEF

Figure 8A:
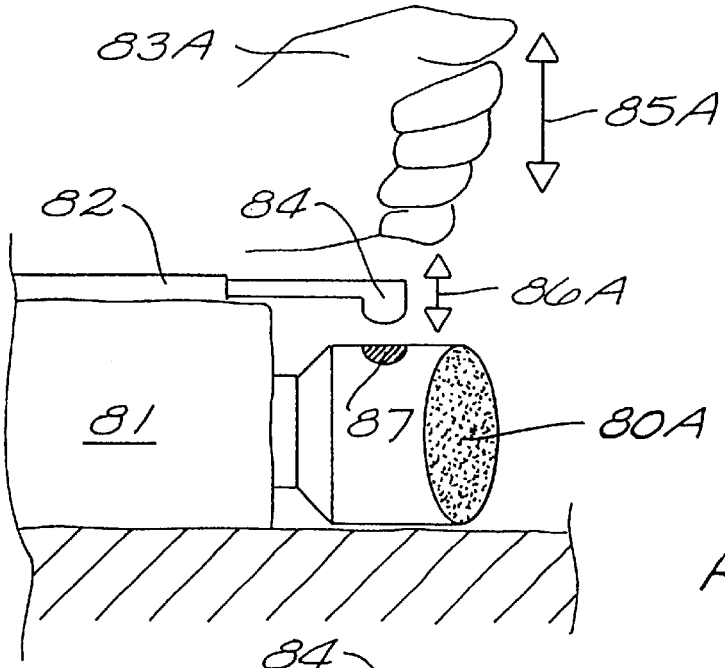
Figure 8B:
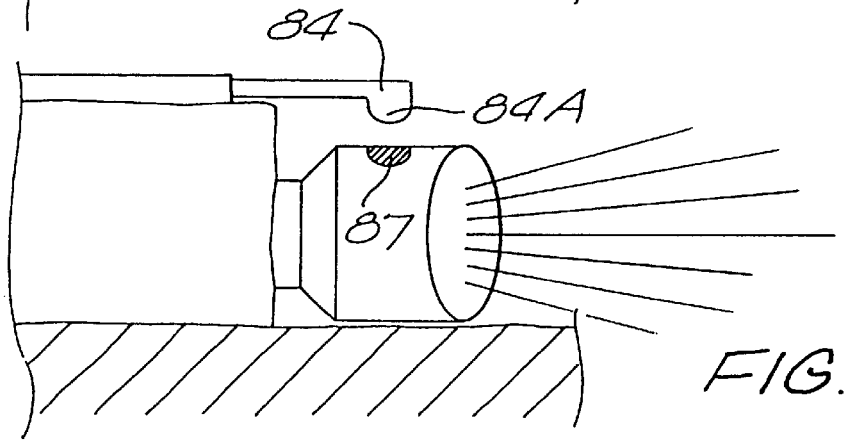
Figure 8C:
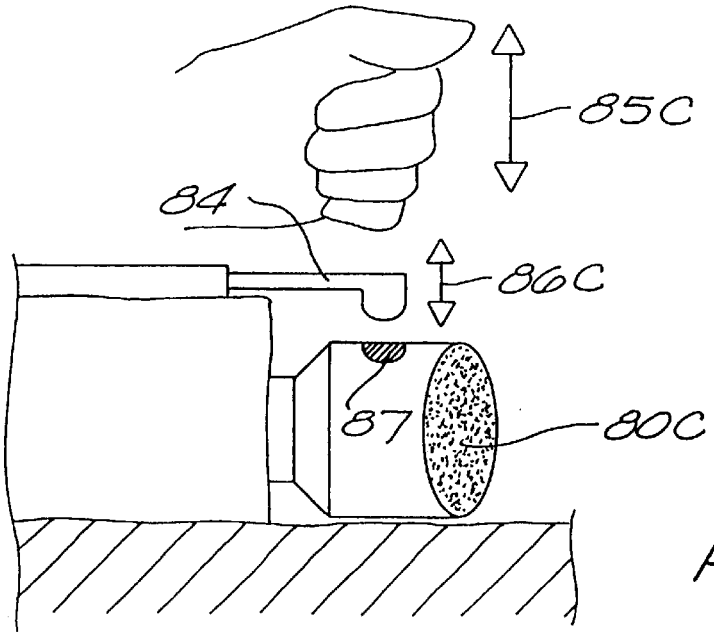

FIGS. 8A, 8B, and 8C are side views of the spring activation of the flashlight.

DRAWINGS IN DETAIL

Figure 1:
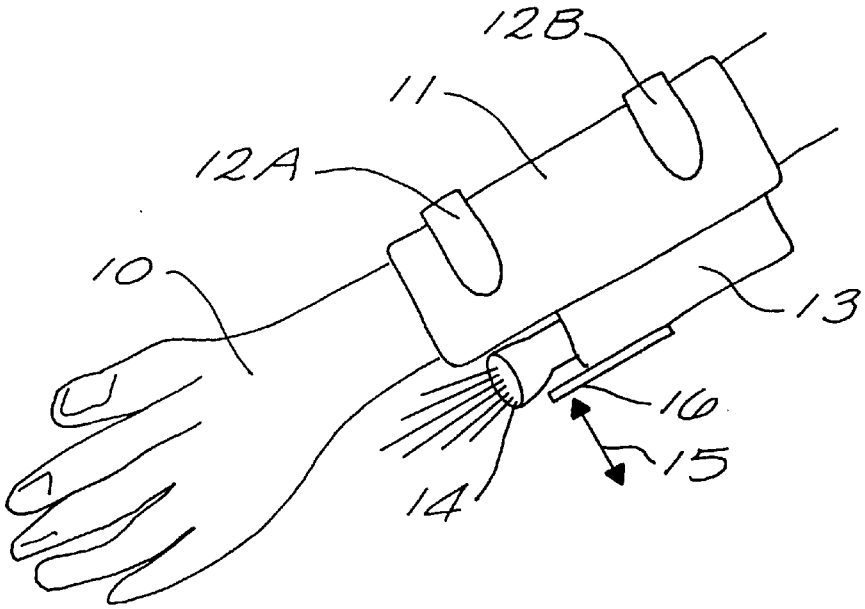
FIG. 1 illustrates the preferred embodiment in use.

FIG. 1 illustrates the preferred embodiment in use.

User 10 has placed band 11 onto their forearm and has activated flashlight 14 by pressing spring mechanism 16 as shown by arrow 15 Flashlight 14 is secured to band 11 by sleeve 13. Flashlight 14 is removable and can be used without the aid of band 11.

Band 11 is secured to user 10 through its elastic nature (not illustrated here) and by securing straps 12A and 12B which allow user 10 to obtain any sought firmness.

Figure 2:
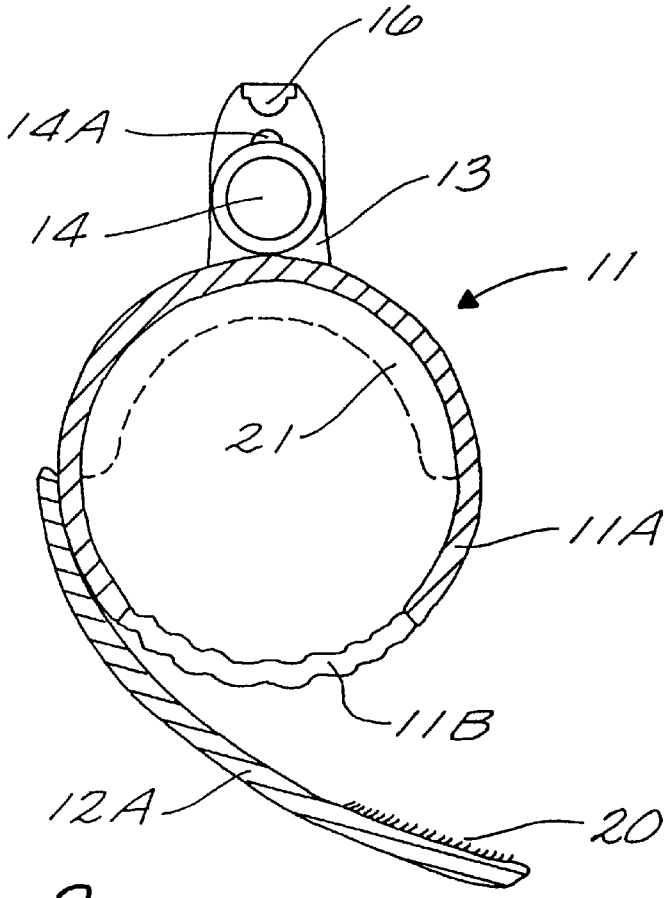
FIG. 2 is a frontal view of the embodiment of FIG. 1.

FIG. 2 is a frontal view of the embodiment of FIG. 1.

Band 11, in this embodiment, has an inelastic portion 11A and an elastic portion 11B. The circumference of band 11 is chosen to be slightly smaller than the circumference of the forearm of the user. In this manner, elastic member 11B secures band 11 to the forearm.

Additional attachment is accomplished using securing band 12A which has hook-and-loop fastener 20 at one end thereof. Hook-and-loop fastener 20 is adapted to fasten to inelastic member 11A.

Flashlight 14 is secured to band 11 using sleeve 13 which is stretched over the handle portion of flashlight 14. Switch 14A of flashlight 14 is positioned below spring mechanism 16 which is used to activate flashlight 14 when pressed upward.

In the preferred embodiment, shield 21, composed of hardened plastic, is incorporated on an interior portion of band 11. Shield 21 is used to provide further protection for the user, such as a police officer, in a knife fight situation.

Figure 3:
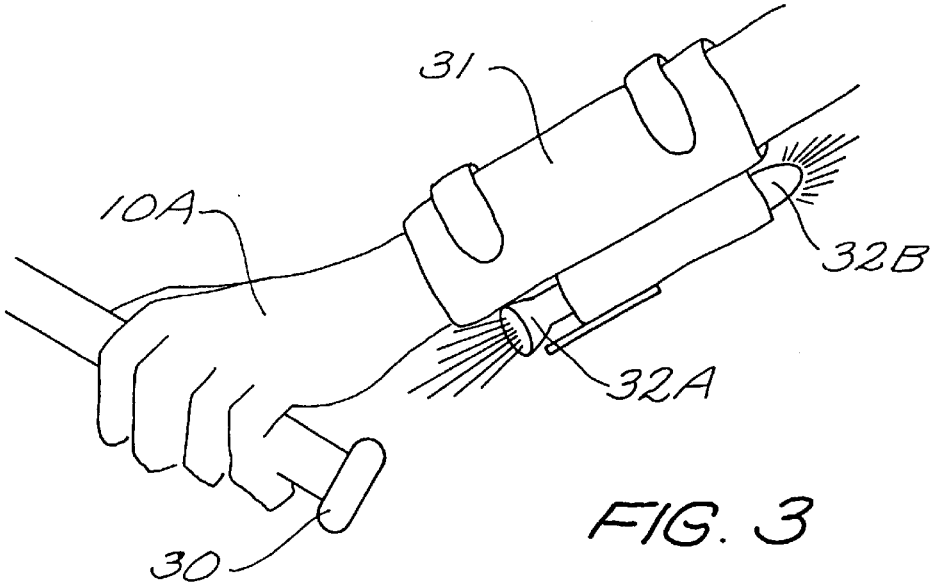
FIG. 3 illustrates an embodiment of the present invention used for bicycle riders.

FIG. 3 illustrates an embodiment of the present invention used for bicycle riders.

In this embodiment, user 10A has placed band 31 on their forearm and is gripping handle 30. Band 31, as illustrated has a flashlight having an illuminating end 32A (providing a traditional white light) and a beacon end 32B which provides a flashing light so that the attention of motorists is drawn to the bicyclist. Through selective activation of the flashlight within band 31, the bicyclist is able to activate either end 32A or 32B.

While the color of band 31 is dark (i.e. dark brown or black) when used by a police officer, in the situation of a bicyclist, the preferred color is a bright light reflecting color such as orange. This provides for an even enhanced visibility of the bicyclist.

Figure 4:
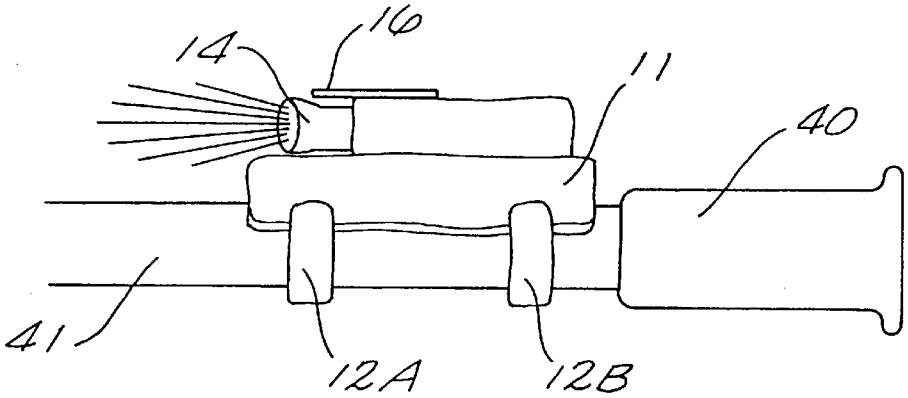
FIG. 4 illustrates the use of the invention when placed on a bicycle.

FIG. 4 illustrates the use of the invention when placed on a bicycle.

This embodiment is similar to that shown in FIG. 1 and provides for band 11 to be crumpled on the top of handle bar 41 and secured thereto using straps 12A and 12B. Light 14 is now positioned to shine ahead of the bicyclist once activated using spring mechanism 16.

In this manner, the bicyclist is able to use the present invention either on the bicycle (and steer in an unencumbered way using handle 40) or attached to their own forearm.

Figure 5:
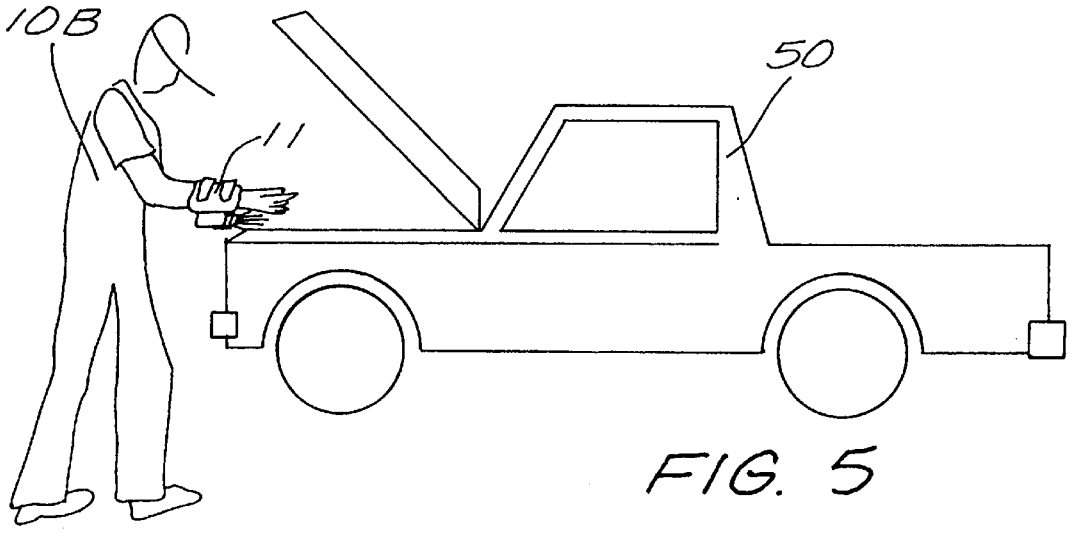
FIG. 5 illustrates the use of this invention to repair a disabled vehicle.

FIG. 5 illustrates the use of this invention to repair a disabled vehicle.

As shown, user 10B is able to attach band 11 and to have both hands free to repair vehicle 50. In this manner, the armband of this invention together with a suitable flashlight would be kept in the tool box for late night repairs and tire changing.

Figure 6:
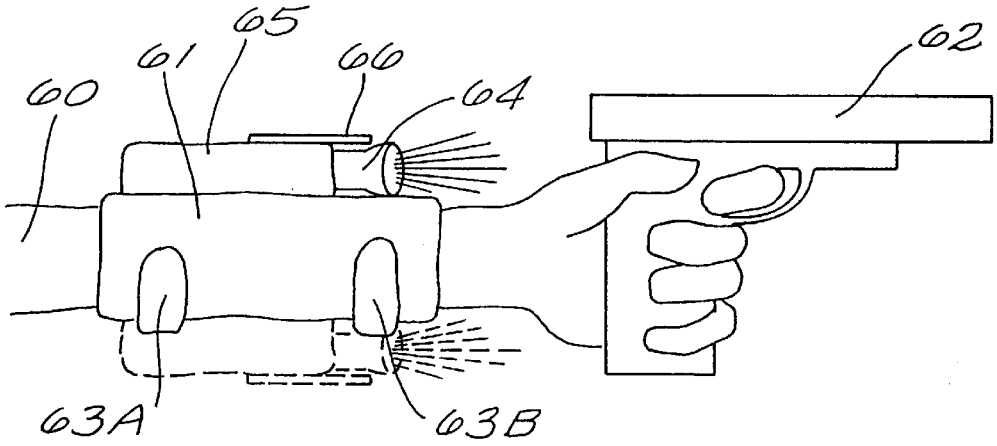
FIG. 6 is a side view of an embodiment of the invention in use with a weapon.

FIG. 6 is a side view of an embodiment of the invention in use with a weapon.

As shown, user 60 has armband 61 placed on their forearm. This frees the user's hand to grasp pistol 62.

Armband 61 is held in place using securing straps 63A and 63B which are placed on either side of the user's forearm muscle bulge. This positioning of the securing straps provides for optimal restraint upon the arm without curtailing the blood flow to the hand.

Activation of flashlight 64, held in sleeve 65, is accomplished by tapping spring 66 which engages the switch (not shown) on flashlight 64. Tapping of spring 66 is accomplished using either the other hand or any other object. In this fashion, flashlight 64 is turned on/off without requiring the use of the operator's free hand.

Figure 7:
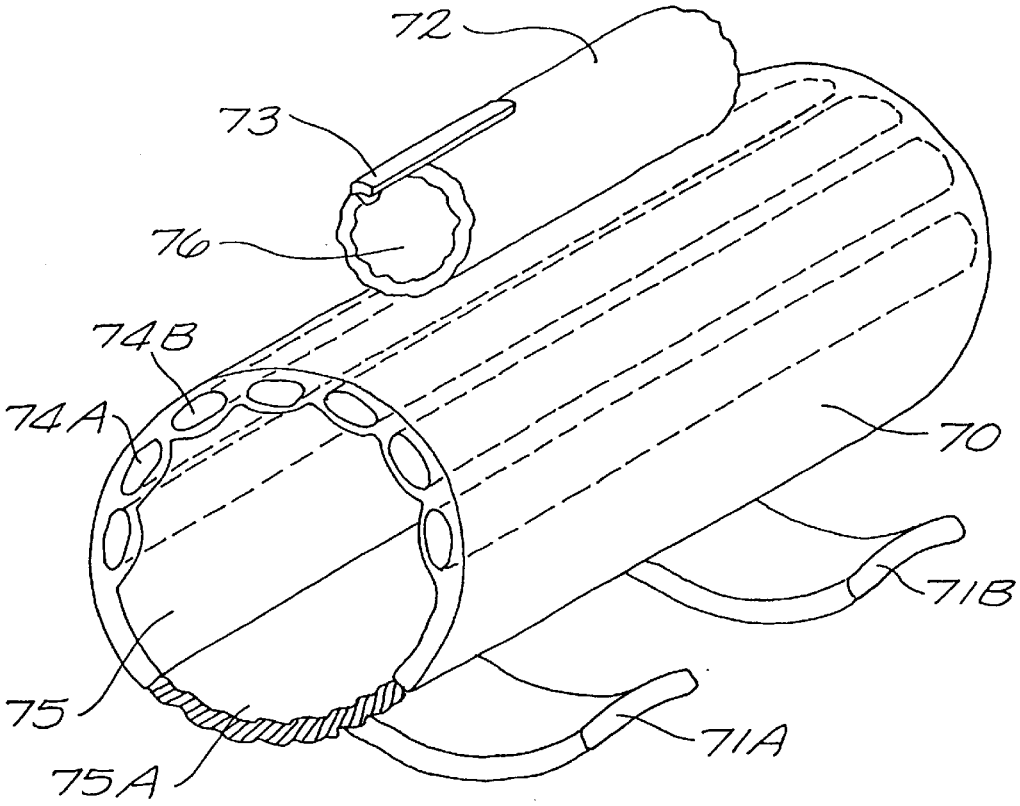
FIG. 7 is a perspective view of an embodiment of the invention utilizing elongated strips as shielding for the armband.

FIG. 7 is a perspective view of an embodiment of the invention utilizing elongated strips as shielding for the armband.

Armband 70 has a circular member 75 which includes an elastic portion 75A. The user's forearm is slipped through the circular member 75 allowing the elastic portion to expand and then slightly compress the armband against the forearm. This compression allows for secondary securement of the armband to the user and more importantly maintains the armband in place while securing straps 71A and 71B are fastened.

As with the other embodiments discussed above, armband 70 includes a sleeve 72 with spring 73 to operate the flashlight (not shown in this illustration). In this embodiment, a preshaped nest 76 is provided for the flashlight. Nest 76 assists in directing the flashlight's beam properly.

Heighten protection for the user is provided by reinforcing shields 74A and 74B which are slid into sleeves within armband 70 (other shields are illustrated but have not been given reference numerals). In this embodiment, since shields 74A and 74B, are easily removed, armband 70 is easily machine washed.

Shields 74A and 74B, made of steel or durable plastic, provide additional protection for the user during a fight to protect the user's forearm against blows and knife thrusts.

FIGS. 8A, 8B, and 8C are side views of the spring activation of the flashlight.

Flashlight 80A (in an "off" condition) of FIG. 8A is secured by sleeve 81 which extends around the handle portion of flashlight 80A.

Spring 84 extends from anchor 82 over switch 87 of the flashlight. By striking (as illustrated by arrow 85A) the end of spring 84 with their hand, 83A, a corresponding movement (arrow 86A) occurs and flashlight 80A goes to an "on" state, FIG. 8B.

As shown, spring 84 is equipped with a "bumps" (preferably made from rubber) or extension 84A which assists in assuring proper engagement between the motion of spring 84 and switch 87.

In a reverse operation, as shown in FIG. 8C, hand motion 85C again forces spring 84 to move as indicated by arrow 86C, to engage switch 87, thereby turning flashlight 80C to an "off" state.

It is clear from the foregoing that the present invention creates a highly improved mechanism to secure a flashlight to a user.

What is claimed is:

1. An armband comprising:

a) a circular member configured to extend around an arm of a user and having, 1) a substantially inelastic portion having a first and a second edge, and, 2) an elastic portion extending from said first edge to the second edge of said substantially inelastic portion;

b) a fastening strap having a first end secured to said substantially inelastic portion proximate to said first edge, a second end of said fastening strap securable to said substantially inelastic portion proximate to said second edge;

c) an elastic loop secured to an outer surface of the substantially inelastic portion of said circular member;

d) a flashlight, a handle thereof secured within said elastic loop; and, e) a spring member, a first end thereof secured to said elastic loop, a second end thereof positioned over a switch on said flashlight.

2. The armband according to claim 1, wherein said fastening strap is securable to the substantially inelastic portion of said circular member using hook-and-loop fasteners.

3. The armband according to claim 1, further including a second fastening strap having a first end thereof secured to said substantially inelastic portion proximate to said first edge, a second end of said second fastening strap securable to said substantially inelastic portion proximate to said second edge.

4. The armband according to claim 3, wherein said second fastening strap is securable to the substantially inelastic portion of said circular member using hook-and-loop fasteners.

5. The armband according to claim 1, further including a rigid shield secured to an inner surface of said substantially inelastic portion of said circular member.

6. The armband according to claim 5, wherein said rigid shield is removable from said circular member.

7. The armband according to claim 1, wherein said flashlight, when activated, includes:

a) a first end emitting a beam of light; and, b) a second end emitting a beacon of light.

8. The armband according to claim 7, wherein said circular member and said fastening strap are light reflective.

9. The armband according to claim 8, wherein said the second end of said spring member includes a rubber button adapted to engage said switch of said flashlight.

10. The armband according to claim 1, wherein said elastic loop includes means for defining a circumference of said elastic loop.

11. The armband according to claim 10, wherein said means for defining includes an elastic strap, a first end attached to said substantially inelastic portion of said circular member, a second end being attachable to said substantially inelastic portion of said circular member.

12. A protective armband comprising:

a) a circular member configured to extend around an arm of a user;

b) a fastening strap having a first end secured to said circular member, a second end of said fastening strap securable to said circular member;

c) a loop secured to an outer surface of said circular member and configured to grasp a handle of a flashlight;

d) a spring member, a first end thereof secured to said loop, a second end thereof positioned over a switch on a flashlight when a flashlight handle is secured in said elastic loop.

13. The protective armband according to claim 12, wherein a portion of said circular member is elastic.

14. The protective armband according to claim 12, further including a second fastening strap having a first end thereof secured to said circular member and a second end of said second fastening strap securable to said circular member.

15. The protective armband according to claim 14, further including a rigid shield securable to an inner surface of said circular member opposite said elastic loop.

16. An armband comprising:

a) a circular member configured to extend around an arm of a user and provide a slight compression of said arm;

b) a first fastening strap having a first end thereof secured to said circular member, a second end thereof being securable to said circular member;

c) a second fastening strap having a first end thereof secured to said circular member, a second end thereof being securable to said circular member;

d) means for clasping a handle of a flashlight, said means for clasping secured to an exterior surface of said circular member e) a spring member, secured to said means for clasping and configured such that external pressure forces an end of said spring member to engage a switch on a flashlight held by said means for clasping.

17. The armband according to claim 16, wherein said first fastening strap and said second fastening strap are securable to said circular member using hook-and-loop fasteners.

18. The armband according to claim 16, further including a rigid shield secured to said circular member.

19. The armband according to claim 18, wherein said rigid shield is removable from said circular member.

20. The armband according to claim 18, wherein said rigid shield includes at least two elongated rigid strips embedded in said circular member.

21. The armband according to claim 20, wherein said circular member includes envelopes adapted to receive individual ones of said at least two elongated rigid strips.

22. The armband according to claim 16, wherein said spring member includes a rubber button adapted to engage a recessed switch on a flashlight when said flashlight is secured by said means for clasping.

23. The armband according to claim 16, wherein said means for clasping includes nesting means for cradling said flashlight when said flashlight is in said means for clasping.

* * * * *